US005630275A

United States Patent [19]

Wexler

[11] Patent Number: 5,630,275

[45] Date of Patent: *May 20, 1997

[54] MULTI-BLADE RAZOR HEAD WITH IMPROVED PERFORMANCE

[75] Inventor: Fred C. Wexler, Madison, Conn.

[73] Assignee: Warner-Lambert Company, Morris Plains, N.J.

[ * ] Notice: The term of this patent shall not extend beyond the expiration date of Pat. No. 5,456,009.

[21] Appl. No.: 522,901

[22] Filed: Sep. 1, 1995

Related U.S. Application Data

[63] Continuation-in-part of Ser. No. 294,463, Aug. 23, 1994, Pat. No. 5,456,009.

[51] Int. Cl.[6] ..... B26B 21/60; B26B 21/02

[52] U.S. Cl. ..... 30/50; 30/346.53; 30/346.54; 30/77

[58] Field of Search ..... 30/50, 77, 346.53, 30/346.54, 346.55

[56] References Cited

U.S. PATENT DOCUMENTS

| | | | |
|---|---|---|---|
| 3,505,734 | 4/1970 | Iten . | |
| 3,774,703 | 11/1973 | Sanderson | 30/346.53 |
| 3,829,969 | 8/1974 | Fischbein et al. | 30/346.54 |
| 3,977,061 | 8/1976 | Lindstrom et al. | 30/346.54 |
| 4,094,066 | 6/1978 | Daniel, Jr. | 30/346.58 |
| 4,170,821 | 10/1979 | Booth | 30/41 |
| 4,211,006 | 7/1980 | Halaby et al. | 30/346.55 |
| 4,252,837 | 2/1981 | Auton . | |
| 4,302,876 | 12/1981 | Emmett | 30/50 |
| 4,603,477 | 8/1986 | Francis | 30/50 |
| 4,912,846 | 4/1990 | Yu | 30/77 |
| 4,914,817 | 4/1990 | Galligan et al. | 30/77 |
| 4,916,814 | 4/1990 | Althaus | 30/50 |
| 5,056,221 | 10/1991 | Thoene | 30/50 |
| 5,063,668 | 11/1991 | Althaus | 30/77 |
| 5,090,124 | 2/1992 | Althaus | 30/50 |
| 5,142,785 | 9/1992 | Grewal et al. | 30/346.54 |
| 5,295,305 | 3/1994 | Hahn et al. | 30/50 |
| 5,305,526 | 4/1994 | Althaus | 30/77 |
| 5,456,009 | 10/1995 | Wexler | 30/50 |

FOREIGN PATENT DOCUMENTS

| | | |
|---|---|---|
| 0348866 | 6/1989 | European Pat. Off. . |
| 0559130 | 3/1993 | European Pat. Off. . |

*Primary Examiner*—Hwei-Siu Payer
*Attorney, Agent, or Firm*—Charles W. Almer

[57] ABSTRACT

The various embodiments of the present invention are directed to razor heads having a plurality of cutting edges wherein the physical characteristics of the cutting edges are different from each other. Among the items which may be varied in the blades are the substrate material, coatings or shape. Preferably, the characteristics of the first blade should be such as to maximize the blade's cutting effect in relation to the skin/beard flow over the guard bar of the razor head. The subsequent blades are such as to maximize the cutting action as the skin flow over the first blade and on to the subsequent blades. In addition, one or more fencing elements may be disposed over discrete, spaced portions of one or both cutting edges to prevent those portions of the cutting edges from contacting the skin being shaved.

18 Claims, 3 Drawing Sheets

MULTI-BLADE RAZOR HEAD WITH IMPROVED PERFORMANCE

This is a continuation-in-part of application Ser. No. 08/294,463 filed Aug. 23, 1994, now U.S. Pat. No. 5,456, 009.

The present invention is directed to razor heads and, more particularly, to razor heads comprising a plurality of cutting edges wherein the cutting edges have different physical characteristics from each other.

BACKGROUND OF THE INVENTION

Many different designs have been proposed in the past for providing a shaving instrument which provides a close, comfortable and safe shave. "Safety razors" are now common wherein a guard bar is disposed forwardly of the cutting edge of a leading blade while a skin-engaging cap member follows a trailing blade of a multi-blade shaving system. The guardbar and cap member help to control the angle at which the skin being shaved meets the cutting edges of the blades.

Since the 1970's razor systems have been marketed containing more than one shaving edge and a number of patents have issued covering such systems with two or more blades contained in the shaving unit. Overall, such multi-bladed shaving systems have been designed with blades that are made to deliver superior closeness, superior safety or some other desirable feature to the consumer. These systems contain blades which are formed from diverse materials and have a variety of coatings applied to them. In addition, the shape and geometry of the blades is generally different for each system.

The base material of the blade is one area in which blades are known to differ. U.S. Pat. No. 5,028,374, issued to Trotta discloses a blade for a safety razor which is manufactured from a block of uncured ceramic material. A portion is cut from the block, and a cutting edge is created by grinding and polishing an edge. U.S. Pat. No. 5,048,191, issued to Hahn and U.S. Pat. No. 5,056,227, issued to Kramer both also disclose blades made from ceramic material. U.S. Pat. No. 3,831,466, issued to Hicks discloses a blade which a blade is constructed from a plurality of vitreous materials.

The coating of blades is another area in which blades differ. U.S. Pat. No. 5,101,565, issued to Trankiem discloses razor blades which are coated with the residue of a heated mixture of a fluorocarbon polymer and a silane. Techniques for including interlayers between the substrate and the coating are also known. U.S. Pat. No. 5,142,785, issued to Grewal discloses a razor blade having an interlayer of molybdenum on the substrate and a outer coating of diamond or diamond-like material on the interlayer. U.S. Pat. No. 5,295,305, issued to Hahn further discloses an interlayer with a diamond or diamond-like coating on the interlayer.

Blade shape is one further factor which varies among systems. U.S. Pat. No. 5,153,992, issued to Brown discloses a blade for a safety razor having a plurality of sharp-edged apertures and a sharpened rectilinear edge for trimming. Further variables in the blade shape, such as circular, angular or polygonal cutting edges have also been disclosed, as have variations in the blade edge geometry caused by double facet or triple facet grinding. All of the above varieties deliver different properties to the blades and hence the quality of the shave experienced by the user can be varied through their use.

Another concept previously disclosed is to wrap all blades of a shaving system with a wire or thread to form a fencing element. This type of shaving system is particularly useful in maximizing safety and for use by people with sensitive skin. U.S. Pat. No. 1,035,548, issued Aug. 13, 1912, discloses a straight razor having a long blade on which is spirally wound a wire or thread to form a fencing element. Another form of fencing element is disclosed by Ferrara in U.S. Pat. No. 3,263,330, issued Aug. 2, 1966, wherein the razor blade cutting edge is encapsulated in a folded sheet of metal having a row of holes through which hair, but not skin, passes for cutting.

U.S. Pat. No. 3,505,734 issued to Iten on Apr. 14, 1970, discloses a cutting blade with a self-contained fencing element in the form of a wire. The wire or thread of selected diameter is wound about the body of the blade encompassing its ultimate edge. The spacing or pitch between successive turns of the wire is controlled relative to its diameter to provide protection to the skin of the user and to diminish the probability of cutting or nicking. The selected critical thread diameter and spacing between successive thread portions at the cutting edge of the blade allows the fenced portions of the blade to be drawn across the skin without coming into contact therewith. Some positional stability is given to the wound wire fencing elements by spot-welding them to the blade at a location back from its edge and by passing the wire through notches in the blade edge.

Another arrangement similar to that of Iten is disclosed in U.S. Pat. No. 3,750,285 to Michelson, issued on Aug. 7, 1973. The disclosed razor blade has a fenced cutting edge comprising a multiplicity of relatively short and thin fencing elements bent into relatively V-shaped form and secured to the blade edge by permanent attachment of the respective ends of each fencing element to the razor blade base structure at points relatively close to the blade cutting edge. Those fencing elements as well may be seated in notches formed in the blade edge or, if relatively softer than the blade edge, may have the blade edge embedded therein.

While the aforementioned designs of Iten and Michelson may be successful in insulating the skin from the ultimate cutting edge of the razor blade, they introduce difficulties into the manufacturing of razor blades incorporating their principal features. Initially, the thread or threads must be of flexible material having precise dimensional conformity. Secondly, it must also be sufficiently flexible for winding about the body of the blade or at least over the blade edge and yet strong enough to withstand severing as it passes over and comes into contact with the blade edge. It must be kept in mind that as the wire comes into contact with the ultimate edge of the blade, the edge being 300 to 500 Angstroms in radius, it necessarily damages the blade edge making such contact portion substantially incapable of providing comfortable shaving characteristics.

Techniques have been disclosed in U.S. patent application No. 645,055 filed Dec. 29, 1975, by Beddall for Printed Blade Shield, and U.S. Pat. No. 4,252,837 to Auton for Blade Shields, all being assigned to the same assignee as the present invention, for placing fencing elements on a blade edge without many of the shortcomings of the aforementioned prior art techniques. Specifically, epoxy resins may be placed on the edge and flanking facets of a blade using ink jet printing techniques or, alternatively, the fencing elements may be deposited by sputtering or ion plating. These techniques overcome some of the objections of the aforementioned prior art techniques. However, the fencing elements so deposited may be subject to dislodgement from the blade in response to normal shaving forces and/or abuse.

U.S. Pat. No. 4,211,006 to Halaby, et al, which issued on Jul. 8, 1980 and which is assigned to the same assignee as the present invention, discloses a razor blade having fencing elements deposited in recessed seats formed in the cutting edge and flanking surfaces of the blade by electroplating.

While the above-referenced publications disclose methods of making blades which will yield shaves with various characteristics, the designs do not allow for a mixing of the various blade characteristics to maximize closeness and comfort. It would therefore be desirable to provide a razor head which is not only comfortable but also provides a close shave. To this end, it would be desirable to provide a razor head which is comfortable and which provides a closer shave than multiple blade razor heads in which the multiple blades are identical to each other.

SUMMARY OF THE INVENTION

The various embodiments of the present invention are directed to razor heads having a plurality of cutting edges wherein the physical characteristics of the cutting edges are different from each other. Among the items which may be varied in the blades are the substrate material, coatings or shape. Preferably, the characteristics of the first blade should be such as to maximize the blade's cutting effect in relation to the skin/beard flow over the guard bar of the razor head. The subsequent blades are such as to maximize the cutting action as the skin flow over the first blade and on to the subsequent blades. In addition, one or more fencing elements may be disposed over discrete, spaced portions of one or both cutting edges to prevent those portions of the cutting edges from contacting the skin being shaved.

According to one preferred embodiment, a razor head is provided with structure for supporting a plurality of blades, a first blade comprising a first cutting edge, and a second blade comprising a second cutting edge. According to this embodiment, the first blade is constructed from a ceramic based material. A diamond or diamond-like material coating is placed on the blade and the geometry of the blade is arranged such that the blade will provide a sharp edge for an extremely close shave. The second blade is constructed with a stainless steel substrate with a first coating of chromium and a second coating of Vydax. The geometry of the second blade is such that it is less sharp than the first blade and will provide a more comfortable shave.

The embodiments of the present invention provide a razor head design which permit the cutting characteristics of shaving to be altered by the different characteristics of the blade to maximize comfort and closeness of shaving. The present invention is particularly suited to provide a safe and close shave to people with regular skin by providing enhanced closeness along with increased comfort. This is particularly desirable for shavers with "normal" skin, as opposed to those with "sensitive" skin.

DETAILED DESCRIPTION

Figure 1:
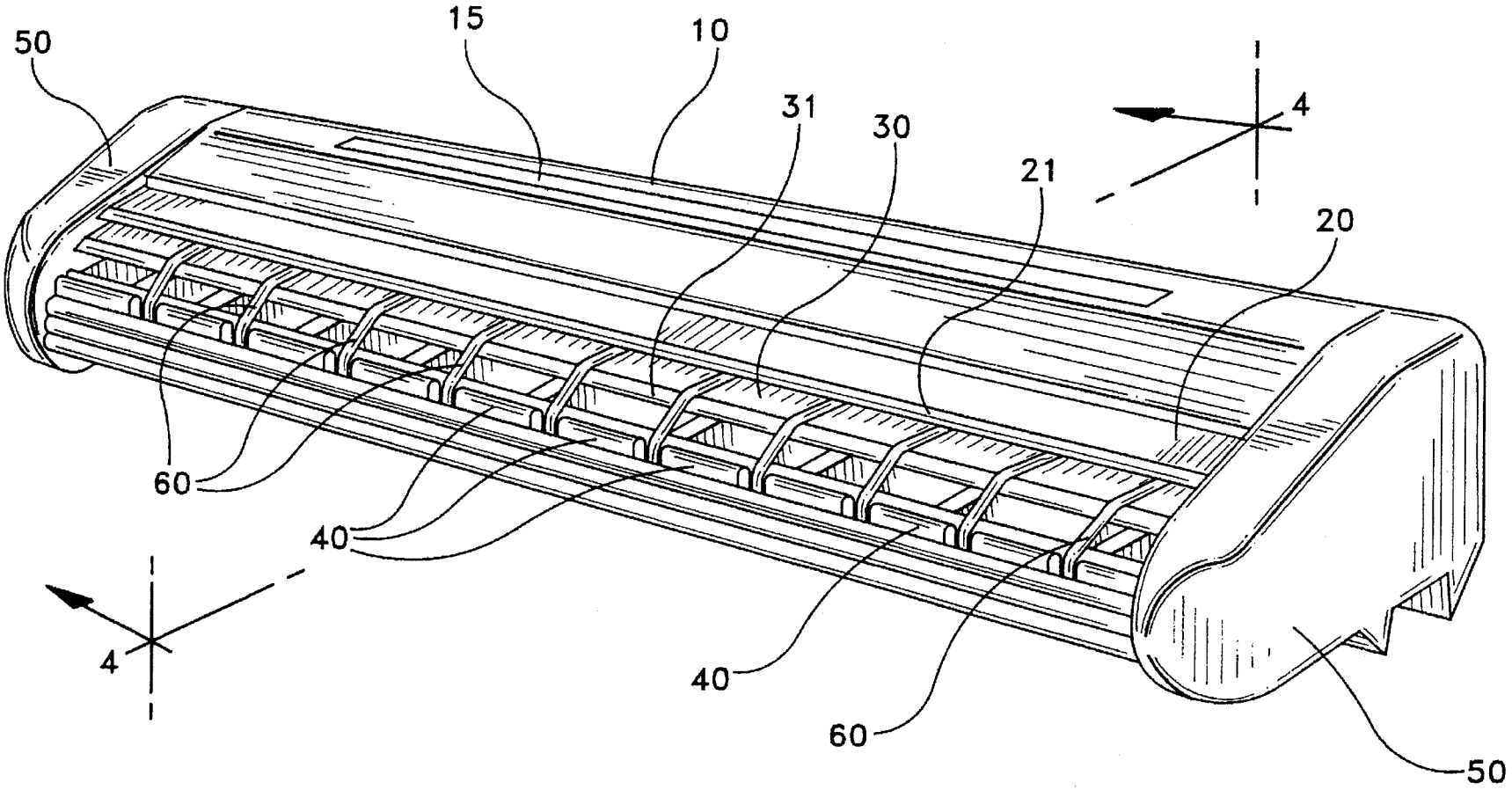
FIG. 1 is a perspective view of one embodiment of the present invention.

The various embodiments of the present invention are directed to shaving systems comprising a plurality of cutting edges. According to the present invention, one cutting edge of the shaving systems has different physical characteristics than the other cutting edge or edges of the same system. "Cutting edge", as used in the present disclosure, refers to the area within about 1 mm. from the ultimate tip of the blade. The area beyond about 1 mm. from the tip of the blade is outside the scope of the "cutting edge". The examples used merely for the purposes of this disclosure are razor heads containing two cutting edges. Razor heads having more than two cutting edges are also within the scope of the invention.

Among the items which may be varied in the cutting edges are the substrate material, the coatings or the blade shape and geometry. Preferably, the characteristics of the first blade should be such as to maximize the blade's cutting effect in relation to the skin/beard flow over the guard bar of the razor head. The subsequent blade or blades are such as to maximize the cutting action as the skin flow over the first blade and on to the subsequent blades.

The substrate material of the cutting edge is one element which may vary between the multiple cutting edges. The substrate comprises a flat, striplike blade and may incorporate substantially any of the materials commonly utilized for conventional razor blades. Of those materials, ferrous metals, such as stainless steels are preferred. Especially preferred are martensitic stainless steels of the type commonly referred to in the trade as "400-Series." These steels incorporate at least about 80% iron and at least about 10% chromium. One especially preferred stainless steel, 440A, consists essentially of about 13 to 15% chromium, about 0.6% chromium and the remainder iron. Other materials may also be used for the substrate of the blades. Included in those other materials are ceramics, glass or any mixtures thereof.

A further variable among the blades is the coating. Typically, razor blade cutting edges are coated with a thin single of multiple layer metal coating that provides enhanced durability and corrosion resistance to the underlying substrate. This coating, often chromium or a chromium/platinum alloy, is deposited at a thickness of only a few hundred angstroms on the ultimate tip of the blade. In addition, other materials are known which may be used as an initial coating on a razor blade substrate. Such additional coating materials include metal oxides, nitrides, carbides, borides, mixtures of a metal and an oxide, nitride or carbide, tungsten carbide, titanium carbonitride, zirconium nitride, titanium aluminum nitride, chromium/boron carbide, chromium/diamond-like carbon, titanium diboride/chromium, titanium diboride/titanium carbonitride composite, ceramics containing binders, molybdenum, diamond, diamond-like material, silicon, silicon carbide, vanadium, tantalum, nickel, niobium, niobium/molybdenum alloys, chromium, boron carbide, titanium carbide, vanadium carbide, chromium carbide, titanium nitride, chromium nitride, boron nitride, hafnium nitride, carbon nitride, alumina, silicon dioxide, titanium dioxide, zirconia, chromium oxide, hafnium, titanium, tungsten, hafnium/diamond-like carbon, niobium/diamond-like carbon, molybdenum/diamond-like carbon, vanadium/diamond-like carbon, silicon/diamond-like carbon, tantalum/diamond-like carbon, silicon carbide/diamond-like carbon, titanium or mixtures thereof. Each of the materials provides a unique set of properties which may be considered when designing the shaving system. The materials may be deposited on the substrate via numerous techniques including sputtering, reactive sputtering, ion beam sputtering, ion plating, electron beam gun evaporation or sublimation, electron beam gun reactive evaporation or sublimation, resistive evaporation, resistive reactive evaporation, cathodic arc evaporation or chemical vapor deposition.

Often, a fluropolymer film is applied to the cutting edge after the coating in order to provide for a more comfortable shave. Consequently, it is imperative that the coating not only adhere to the substrate, but also provide a location for adherence of the film coating. The film provides lubrication between the blade and the skin being shaved to prevent the hair from being "pulled" during shaving. Preferably, the film is a fluorinated polyolefin or a copolymer or blend including the fluorinated polyolefin. The film preferably includes polytetrafluoroethylene (PTFE). A preferred film containing PTFE is VYDAX which is commercially available from the DuPont Company of Wilmington, Del., USA.

A further factor which may be varied between blades is the shape of the blade. Various possibilities exist whereby the blade may be constructed so that the cutting edge is polygonal, angular, circular, or provided with a multiple cutting edges. The shape of the blade may be chosen to provide for the desired cut for the particular blade. Further, indentations may be placed on the blade which allow for fencing of the blade.

One additional factor which may be varied in the present disclosure is providing a cutting edge which is substantially continuously unobstructed while a plurality of discrete portions of another cutting edge are shielded by at least one fencing element which prevents those discrete portions of the cutting edge from contacting the skin surface being shaved. A preferred embodiment of the present invention comprises a razor head having at least two blades wherein portions of the cutting edge of one of the blades are shielded with at least one fencing element which effectively prevents contact between discrete, spaced portions of the cutting edge and the surface being shaved. The cutting edge of the other blade is substantially continuously unobstructed.

Figure 2:
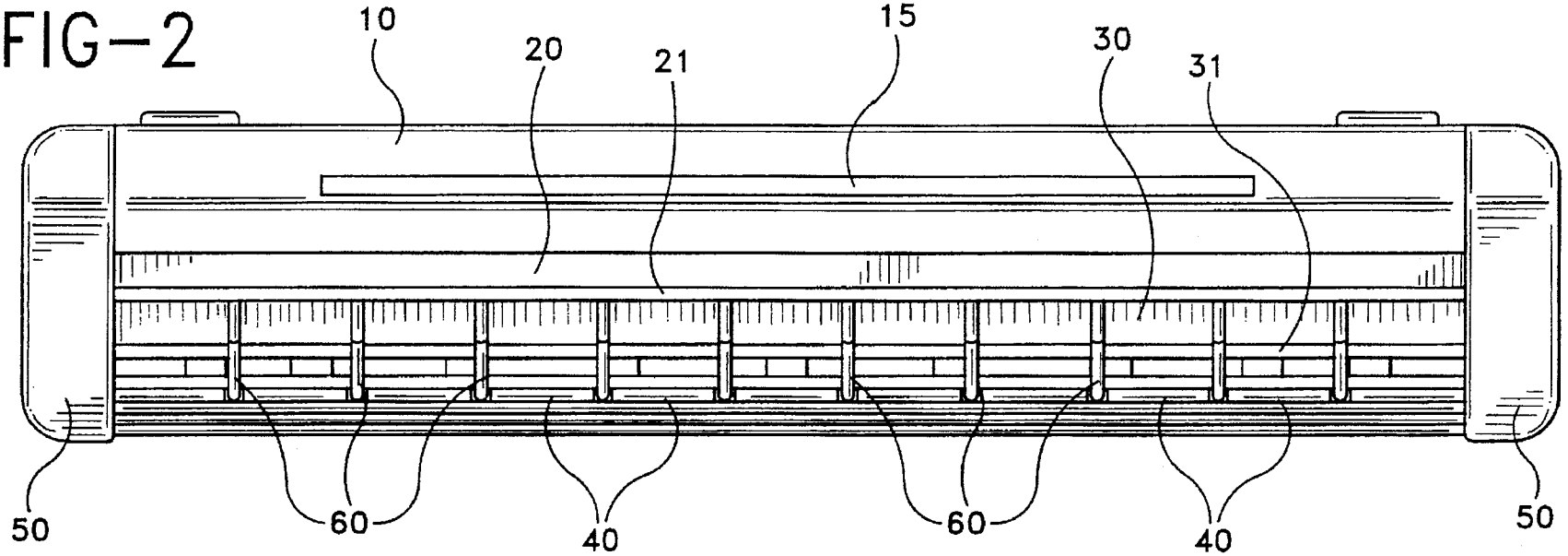
FIG. 2 is a top view of the razor shown in FIG. 1.
Figure 3:
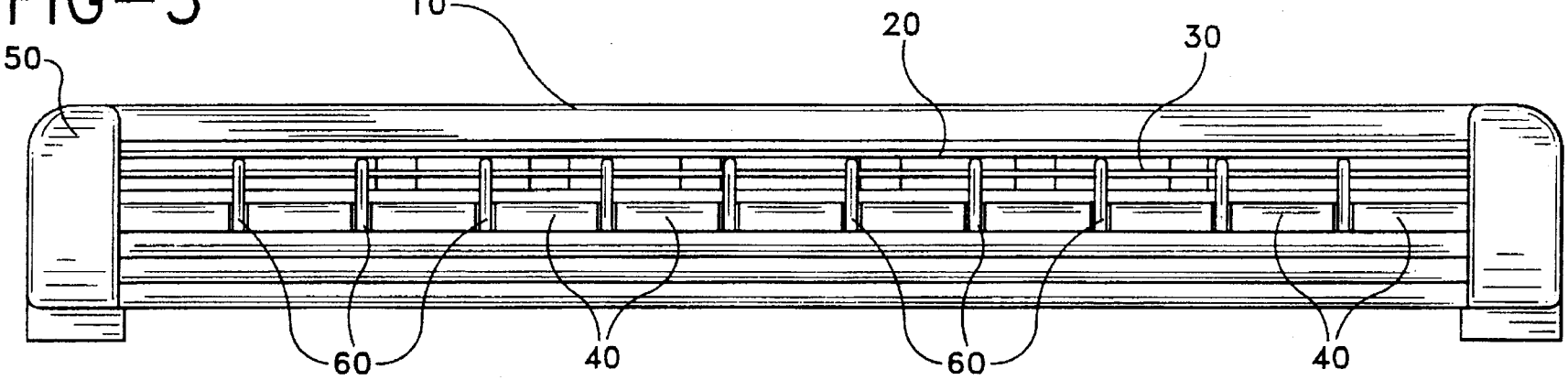
FIG. 3 is a front view of the razor head shown in FIG. 1.
Figure 4:
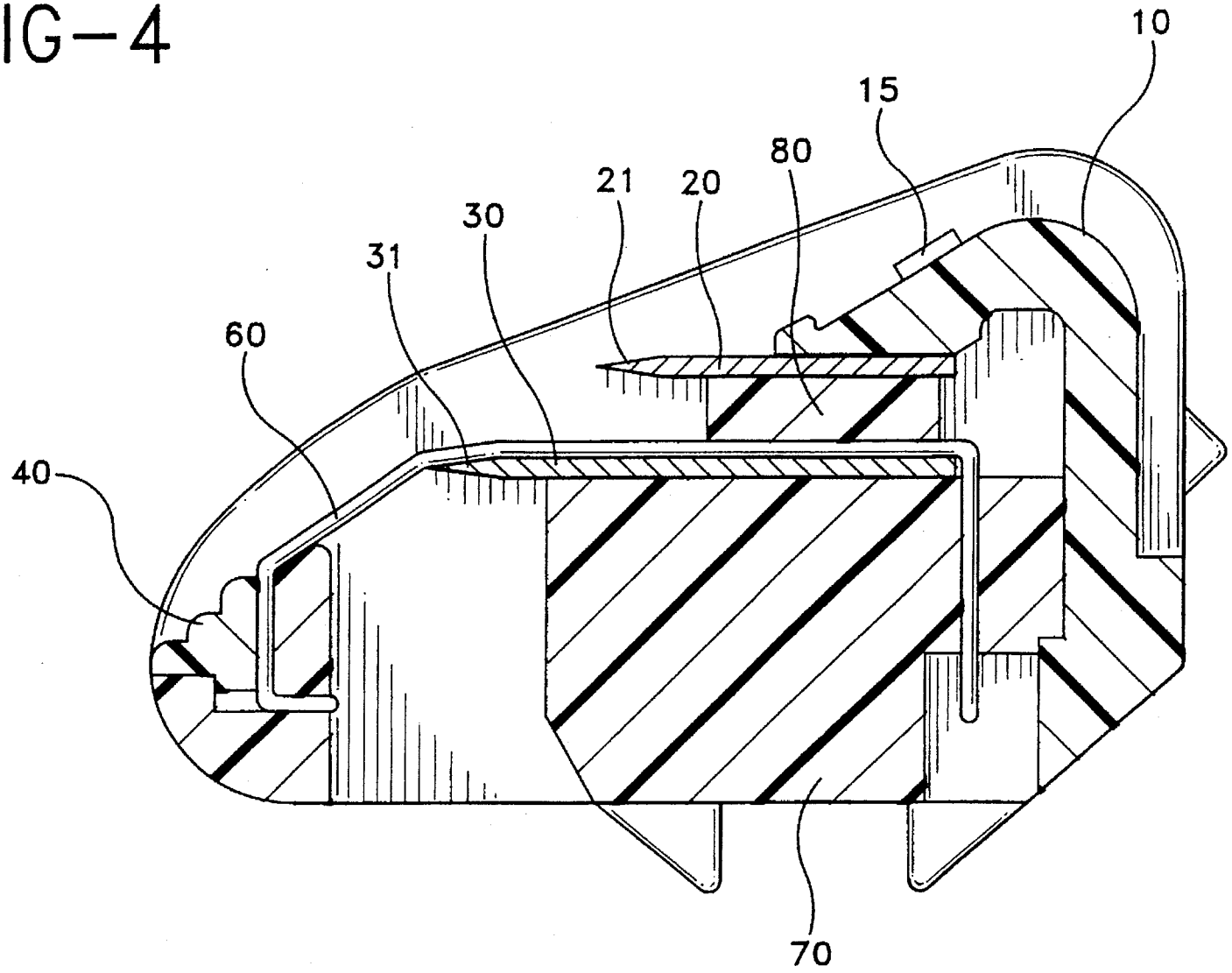
FIG. 4 is a cross-sectional of view taken along lines 4—4 of FIG. 1.

One embodiment of the present invention wherein at least one blade is fenced is illustrated in FIGS. 1 to 4 wherein a razor head comprises a cap 10, a cap blade 20, seat blade 30, and segmented guardbar 40 positioned between sidewalls 50. While the illustrated razor head is in the form of a cartridge adapted to be connected to a separate razor, the advantages of the present invention are equally applicable to other razor heads and other shaving systems. As used herein, the term "razor head" is meant to include cartridges adapted to be connected to a separate razor as well as the operative cutting portion of a disposable razor wherein the handle and cutting portion are formed as a single unit.

As shown in the Figures, cap blade 20 comprises a cutting edge 21 which is unobstructed for substantially its entire length. It will be appreciated that for purposes of the present invention, it is not necessary that the entire cutting edge of the "unobstructed" blade be exposed for contact with the surface being shaved. It is common in previously known shaving systems to position the corners of a substantially rectangular blade within shielded portions of the support structure, such as sidewalls 50, in order to minimize the risk of cutting the surface being shaved during shaving. As used herein, the term "substantially, continuously unobstructed" is used to indicate that a portion of the cutting edge equal to at least 50% of the entire cutting edge is continuously exposed for cutting hair.

With reference again to the Figures, it can be seen that a plurality of discrete, spaced portions of cutting edge 31 of seat blade 30 are prevented from contacting the skin surface being shaved by fencing elements 60. As best shown in the cross-sectional view of FIG. 4, according to this illustrated embodiment of the present invention, each fencing element 60 is advantageously positioned in close proximity to the upper surface of seat blade 30 and the upper side of cutting edge 31. Each fencing element is maintained in position by portions of the support structure disposed forwardly and rearwardly of seat blade 30. In the manner illustrated, the forward and rearward portions of fencing element 60 are locked within the molded thermoplastic material. According to this preferred, illustrated embodiment of the present invention, there is no portion of seat blade 30 which extends continuously for more than 15% of the entire cutting edge between fencing elements 60.

Though not illustrated in detail in the Figures, the illustrated shaving cartridge is also provided on its lower side with suitable connecting members for attachment to a razor. The materials used for forming the various elements of the razor head may include a wide variety of materials. For example, it is known in the art to use thermoplastics which are particularly suited for injection molding and which have excellent durability and shelf life in the environments particularly encountered during shaving, shipping and storing.

While the illustrated fencing elements 60 are formed as a continuous filament which wraps in a generally spiral fashion around one or more, but less than all, of the blades, it is also within the scope of the present invention to use a plurality of discrete elements. It is also possible to use fencing elements which are deposited in recessed guard seats such as those disclosed in U.S. Pat. No. 4,211,006 to Halaby et al, and assigned to the same assignee as the present invention, which is hereby incorporated by reference. Furthermore, one or mere fencing elements can be formed as a stamped sheet, e.g. by stamping holes in a metallic foil.

Though the illustrated embodiment comprises a seat blade having a plurality of fencing elements and a substantially continuously unobstructed cap blade, this arrangement can be reversed within the scope of the present invention. Thus the cap blade may be provided with fencing elements while the seat blade can be substantially, continuously unobstructed. Furthermore, it is within the scope of the present invention to provide a shaving system with more than two blades having cutting edges wherein at least one cutting edge is substantially, continuously unobstructed while at least one other cutting edge is protected by fencing elements.

Another preferred aspect of the present invention comprises the incorporation of a shaving aid on one or more of the skin-engaging surfaces of the shaving system.

As disclosed in U.S. Pat. No. 4,170,821 to Booth, which is hereby incorporated by reference, a shaving aid may comprise one or various combinations of the following:

A. A lubricating agent for reducing the frictional forces between the razor and the skin, e.g., a micro-encapsulated silicone oil.

B. An agent which reduces the drag between the razor parts and the shaver's face, e.g., a polyethylene oxide in the range of molecular weights between 100,000 and 6,000,000; a non-ionic polyacrylamide; and/or a natural polysaccaride derived from plant materials such as "guar gum".

C. An agent which modifies the chemical structure of the hair to allow the razor blade to pass through the whiskers very easily, e.g., a depilatory agent is one example.

D. A cleaning agent which allows the whisker and skin debris to be washed more easily from the razor parts during shaving, e.g., a silicon polyethylene oxide block copolymer and detergent such as sodium lauryl sulphate.

E. A medicinal agent for killing bacteria, or repairing skin damage and abrasions.

F. A cosmetic agent for softening, smoothing, conditioning or improving the skin.

G. A blood coagulant for the suppression of bleeding that occurs from nicks and cuts.

Alternatively, the shaving aid may comprise one or mere of the shaving aids disclosed in U.S. Pat. No. 5,056,221 to Thoene, which is also hereby incorporated by reference. A shaving aid 15 dispose on cap 10 is shown in the FIGS. 1 and 2.

According to the present invention, any combination of the various substrate or coating types may be used in a single razor head. For example, a razor head may have one blade constructed from stainless steel with a titanium carbonitride coating and a second blade constructed from ceramics with the same or a different coating. Conversely, another example of the present invention would provide a razor head with blades constructed from the same material but with different coatings.

According to one preferred embodiment of the present invention, a razor head is provided with structure for supporting a plurality of blades, a first blade comprising a first cutting edge, and a second blade comprising a second cutting edge. According to this embodiment, the first blade is constructed from a ceramic based material. A diamond or diamond-like material coating is placed on the blade and the geometry of the blade is arranged such that the blade will provide a sharp edge for an extremely close shave. The second blade is constructed with a stainless steel substrate with a first coating of chromium and a second coating of Vydax. The geometry of the second blade is such that it is less sharp than the first blade and will provide a more comfortable shave.

It is also within the scope of the present invention to provide a system wherein one of the blades is fenced and the other blade is not fenced. According to such a system, one of the blades may have other different qualities, such as shape or coating, than the other. The fenced blade would allow for increased comfort and safety for the user, while the other blade would provide the sharp cutting edge necessary for a close, clean shave.

While there have been described what are presently believed to be the preferred embodiments of the invention, those skilled in the art will realize that various changes and modifications may be made to the invention without departing from the spirit and scope of the invention, and it is intended to claim all such changes and modifications as fall within the scope of the invention.

I claim:

1. A razor head comprising:

means for supporting a plurality of blades;

a first blade comprising a first cutting edge and a second blade comprising a second cutting edge;

wherein said first blade is constructed from a first material and said second blade is constructed from a second material, and wherein said first material and said second material are different from each other.

2. A razor head according to claim 1, wherein said first material is selected from the group consisting of ferrous metals, stainless steel, martensitic stainless steel, iron, ceramics, glass, chromium or mixtures thereof and said second material is selected from the group consisting of ferrous metals, stainless steel, martensitic stainless steel, iron, ceramics, glass, chromium or mixtures thereof.

3. A razor head according to claim 1 wherein said first cutting edge and said second cutting edge are coated with a material selected from the group consisting of metal oxides, nitrides, carbides, borides, mixtures of a metal and an oxide, nitride or carbide, tungsten carbide, titanium carbonitride, zirconium nitride, titanium aluminum nitride, chromium/boron carbide, chromium/diamond-like carbon, titanium diboride/chromium, titanium diboride/titanium carbonitride composite, ceramics containing binders, molybdenum, diamond, diamond-like material, silicon, silicon carbide, vanadium, tantalum, nickel, niobium, niobium/molybdenum alloys, VYDAX, PTFE, chromium, boron carbide, titanium carbide, vanadium carbide, chromium carbide, titanium nitride, chromium nitride, boron nitride, hafnium nitride, carbon nitride, alumina, silicon dioxide, titanium dioxide, zirconia, chromium oxide, hafnium, titanium, tungsten, hafnium/diamond-like carbon, niobium/diamond-like carbon, molybdenum/diamond-like carbon, vanadium/diamond-like carbon, silicon/diamond-like carbon, tantalum/diamond-like carbon, silicon carbide/diamond-like carbon, titanium or mixtures thereof.

4. A razor head according to claim 1 wherein said first cutting edge is coated with a first coating material and said second cutting edge is coated with a second coating material, and wherein said first coating material and said second coating material are different from each other.

5. A razor head according to claim 4, wherein said first coating material is selected from the group consisting of metal oxides, nitrides, carbides, borides, mixtures of a metal and an oxide, nitride or carbide, tungsten carbide, titanium carbonitride, zirconium nitride, titanium aluminum nitride, chromium/boron carbide, chromium/diamond-like carbon, titanium diboride/chromium, titanium diboride/titanium carbonitride composite, ceramics containing binders, molybdenum, diamond, diamond-like material, silicon, silicon carbide, vanadium, tantalum, nickel, niobium, niobium/molybdenum alloys, VYDAX, PTFE, chromium, boron carbide, titanium carbide, vanadium carbide, chromium carbide, titanium nitride, chromium nitride, boron nitride, hafnium nitride, carbon nitride, alumina, silicon dioxide, titanium dioxide, zirconia, chromium oxide, hafnium, titanium, tungsten, hafnium/diamond-like carbon, niobium/diamond-like carbon, molybdenum/diamond-like carbon, vanadium/diamond-like carbon, silicon/diamond-like carbon, tantalum/diamond-like carbon, silicon carbide/diamond-like carbon, titanium or mixtures thereof and said second coating material is selected from the group consisting of metal oxides, nitrides, carbides, borides, mixtures of a metal and an oxide, nitride or carbide, tungsten carbide, titanium carbonitride, zirconium nitride, titanium aluminum nitride, chromium/boron carbide, chromium/diamond-like carbon, titanium diboride/chromium, titanium diboride/titanium carbonitride composite, ceramics containing binders, molybdenum, diamond, diamond-like material, silicon, silicon carbide, vanadium, tantalum, nickel, niobium, niobium/molybdenum alloys, VYDAX, PTFE, chromium, boron carbide, titanium carbide, vanadium carbide, chromium carbide, titanium nitride, chromium nitride, boron nitride, hafnium nitride, carbon nitride, alumina, silicon dioxide, titanium dioxide, zirconia, chromium oxide, hafnium, titanium, tungsten, hafnium/diamond-like carbon, niobium/diamond-like carbon, molybdenum/diamond-like carbon, vanadium/diamond-like carbon, silicon/diamond-like carbon, tantalum/diamond-like carbon, silicon carbide/diamond-like carbon, titanium or mixtures thereof.

6. A razor head according to claim 4 wherein at least one of the plurality of blades is provided with at least one fencing element, wherein said at least one fencing element prevents a portion of said first cutting edge from contacting a surface being shaved and wherein said second cutting edge is substantially continuously unobstructed.

7. A razor head according to claim 1, wherein at least one of the plurality of blades is provided with at least one fencing element, wherein said at least one fencing element prevents a portion of said first cutting edge from contacting a surface being shaved and wherein said second, cutting edge is substantially continuously unobstructed.

8. A razor head according to claim 1, further comprising a shaving aid.

9. A razor head comprising:

means for supporting a plurality of blades;

a first blade comprising a first cutting edge and a second blade comprising a second cutting edge;

wherein said first cutting edge is of a first shape and said second cutting edge is of a second shape and wherein said first cutting edge is coated with a first coating material and said second cutting edge is coated with a second coating material, and wherein said first coating material and said second coating material are different from each other.

10. A razor head according to claim 9 wherein said first cutting edge and said second cutting edge are coated with a material selected from the group consisting of metal oxides, nitrides, carbides, borides, mixtures of a metal and an oxide, nitride or carbide, tungsten carbide, titanium carbonitride, zirconium nitride, titanium aluminum nitride, chromium/boron carbide, chromium/diamond-like carbon, titanium diboride/chromium, titanium diboride/titanium carbonitride composite, ceramics containing binders, molybdenum, diamond, diamond-like material, silicon, silicon carbide, vanadium, tantalum, nickel, niobium, niobium/molybdenum alloys, VYDAX, chromium, boron carbide, titanium carbide, vanadium carbide, chromium carbide, titanium nitride, chromium nitride, boron nitride, hafnium nitride, carbon nitride, alumina, silicon dioxide, titanium dioxide, zirconia, chromium oxide, hafnium, titanium, tungsten, hafnium/diamond-like carbon, niobium/diamond-like carbon, molybdenum/diamond-like carbon, vanadium/diamond-like carbon, silicon/diamond-like carbon, tantalum/diamond-like carbon, silicon carbide/diamond-like carbon, titanium or mixtures thereof.

11. A razor head according to claim 9, wherein said first coating material is selected from the group consisting of metal oxides, nitrides, carbides, borides, mixtures of a metal and an oxide, nitride or carbide, tungsten carbide, titanium carbonitride, zirconium nitride, titanium aluminum nitride, chromium/boron carbide, chromium/diamond-like carbon, titanium diboride/chromium, titanium diboride/titanium carbonitride composite, ceramics containing binders, molybdenum, diamond, diamond-like material, silicon, silicon carbide, vanadium, tantalum, nickel, niobium, niobium/molybdenum alloys, VYDAX, chromium, boron carbide, titanium carbide, vanadium carbide, chromium carbide titanium nitride, chromium nitride, boron nitride, hafnium nitride, carbon nitride, alumina, silicon dioxide, titanium dioxide, zirconia, chromium oxide, hafnium, titanium, tungsten, hafnium/diamond-like carbon, niobium/diamond-like carbon, molybdenum/diamond-like carbon, vanadium/diamond-like carbon, silicon/diamond-like carbon, tantalum/diamond-like carbon, silicon carbide/diamond-like carbon, titanium or mixtures thereof and said second coating material is selected from the group consisting of metal oxides, nitrides, carbides, borides, mixtures of a metal and an oxide, nitride or carbide, tungsten carbide, titanium carbonitride, zirconium nitride, titanium aluminum nitride, chromium/boron carbide, chromium/diamond-like carbon, titanium diboride/chromium, titanium diboride/titanium carbonitride composite, ceramics containing binders, molybdenum, diamond, diamond-like material, silicon, silicon carbide, vanadium, tantalum, nickel, niobium, niobium/molybdenum alloys, VYDAX, chromium, boron carbide, titanium carbide, vanadium carbide, chromium carbide, titanium nitride, chromium nitride, boron nitride, hafnium nitride, carbon nitride, alumina, silicon dioxide, titanium dioxide, zirconia, chromium oxide, hafnium, titanium, tungsten, hafnium/diamond-like carbon, niobium/diamond-like carbon, molybdenum/diamond-like carbon, vanadium/diamond-like carbon, silicon/diamond-like carbon, tantalum/diamond-like carbon, silicon carbide/diamond-like carbon, titanium or mixtures thereof.

12. A razor head according to claim 9, wherein at least one of the plurality of blades is provided with at least one fencing element, wherein said at least one fencing element prevents a portion of said first cutting edge from contacting a surface being shaved and wherein said second cutting edge is substantially continuously unobstructed.

13. A razor head according to claim 9 wherein at least one of the plurality of blades is provided with at least one fencing element, wherein said at least one fencing element prevents a portion of said first cutting edge from contacting a surface being shaved and wherein said second cutting edge is substantially continuously unobstructed.

14. A razor head according to claim 11, further comprising a shaving aid.

15. A razor head comprising:

means for supporting a plurality of blades;

a first blade comprising a first cutting edge and a second blade comprising a second cutting edge;

wherein said first cutting edge is coated with a first coating material and said second cutting edge is coated with a second coating material, and wherein said first coating material and said second coating material are different from each other.

16. A razor head according to claim 15, wherein said first material is selected from the group consisting of metal oxides, nitrides, carbides, borides, mixtures of a metal and an oxide, nitride or carbide, tungsten carbide, titanium carbonitride, zirconium nitride, titanium aluminum nitride, chromium/boron carbide, chromium/diamond-like carbon, titanium diboride/chromium, titanium diboride/titanium carbonitride composite, ceramics containing binders, molybdenum, diamond, diamond-like material, silicon, silicon carbide, vanadium, tantalum, nickel, niobium, niobium/molybdenum alloys, VYDAX, chromium, boron carbide, titanium carbide, vanadium carbide, chromium carbide, titanium nitride, chromium nitride, boron nitride, hafnium nitride, carbon nitride, alumina, silicon dioxide, titanium dioxide, zirconia, chromium oxide, hafnium, titanium, tungsten, hafnium/diamond-like carbon, niobium/diamond-like carbon, molybdenum/diamond-like carbon, vanadium/diamond-like carbon, silicon/diamond-like carbon, tantalum/diamond-like carbon, silicon carbide/diamond-like carbon, titanium or mixtures thereof and said second material is selected from the group consisting of metal oxides, nitrides, carbides, borides, mixtures of a metal and an oxide, nitride or carbide, tungsten carbide, titanium carbonitride, zirconium nitride, titanium aluminum nitride, chromium/boron carbide, chromium/diamond-like carbon, titanium diboride/chromium, titanium diboride/titanium carbonitride composite, ceramics containing binders, molybdenum, diamond, diamond-like material, silicon, silicon carbide, vanadium, tantalum, nickel, niobium, niobium/molybdenum alloys, VYDAX, chromium, boron carbide, titanium carbide, vanadium carbide, chromium carbide, titanium nitride, chromium nitride, boron nitride, hafnium nitride, carbon nitride, alumina, silicon dioxide, titanium dioxide, zirconia, chromium oxide, hafnium, titanium, tungsten, hafnium/diamond-like carbon, niobium/diamond-like carbon, molybdenum/diamond-like carbon, vanadium/diamond-like carbon, silicon/diamond-like carbon, tantalum/diamond-like carbon, silicon carbide/diamond-like carbon, titanium or mixtures thereof.

17. A razor head according to claim 15 wherein at least one of the plurality of blades is provided with at least one fencing element, wherein said at least one fencing element prevents a portion of said first cutting edge from contacting a surface being shaved and wherein said second cutting edge is substantially continuously unobstructed.

18. A razor head according to claim 15, further comprising a shaving aid.

* * * * *